United States Patent [19]

Holmes et al.

[11] Patent Number: 4,817,644

[45] Date of Patent: Apr. 4, 1989

[54] APPARATUS AND METHOD FOR THE SAFE AND EFFECTIVE, LARGE SCALE REMOVAL AND DISPOSAL OF HAZARDOUS MATERIALS FROM BUILDING COMPONENTS

[75] Inventors: Richard W. Holmes, Westport, Conn.; Jaime A. Escobar, Queens Village, N.Y.

[73] Assignee: Envirosafe Corp., New York, N.Y.

[21] Appl. No.: 920,025

[22] Filed: Oct. 17, 1986

[51] Int. Cl.[4] ..... B08B 7/00

[52] U.S. Cl. ..... 134/6; 134/25.1; 134/25.4; 134/36; 134/42

[58] Field of Search ..... 134/6, 10, 21, 42; 15/227, 320; 98/115 LH, 115 SB; 55/DIG. 29, DIG. 46; 128/1 R, 1 B; 138/97; 312/1

[56] References Cited

U.S. PATENT DOCUMENTS

| | | | |
|---|---|---|---|
| 3,051,164 | 8/1962 | Trexler | 128/1 B |
| 3,354,922 | 11/1967 | James | 146/215 |
| 3,709,210 | 1/1973 | Matthews | 128/1 R |
| 3,744,055 | 7/1973 | Brendgord | 2/2 |
| 3,802,416 | 4/1974 | Cazalis | 128/1 R |
| 3,888,556 | 6/1975 | Strong et al. | 312/1 |
| 4,026,286 | 5/1977 | Trexler | 128/204 |
| 4,059,903 | 11/1977 | Piet et al. | 32/40 R |
| 4,335,712 | 6/1982 | Trexler | 128/1 R |
| 4,339,163 | 7/1982 | Jacobson et al. | 312/1 |
| 4,366,809 | 1/1983 | Trexler | 128/1 R |
| 4,626,291 | 12/1986 | Natale | 134/21 |

FOREIGN PATENT DOCUMENTS

| | | | |
|---|---|---|---|
| 3004066 | 2/1980 | Fed. Rep. of Germany | 312/1 |
| 1146767 | 1/1967 | United Kingdom | 310/214 |
| 1567270 | 5/1980 | United Kingdom | 312/1 |

*Primary Examiner*—Curtis R. Davis
*Assistant Examiner*—Sharon T. Cohen
*Attorney, Agent, or Firm*—Gottlieb, Rackman & Reisman

[57] ABSTRACT

New and improved apparatus and method for the safe and effective, large scale removal and disposal of hazardous materials, for example frianble asbestos-containing materials, from building components are provided; and comprise a sheet-like body member, and one or more generally elongate closed-ended chutes operatively connected to the body member. The body member and chute(s) are made of non-rigid materials which are impervious to the hazardous materials. In use, the body member is sealed around the building component in question to enclose the same, the hazardous material removed from the thusly enclosed component for containment in the enclosure, and moved therefrom into and through the chute(s) for periodic packaging and disposal therewith through the sealing and cutting of successive chute portions.

20 Claims, 7 Drawing Sheets

FIG. 7
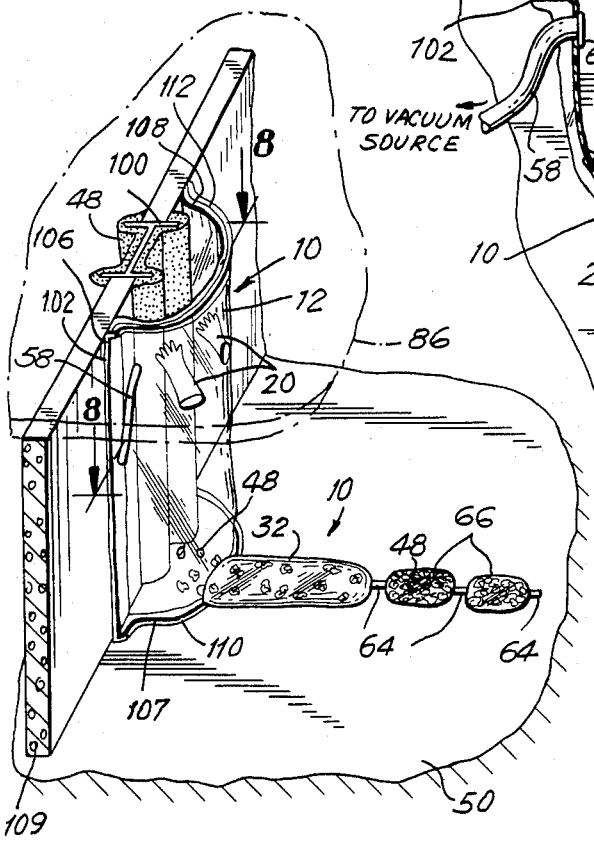
FIG. 8
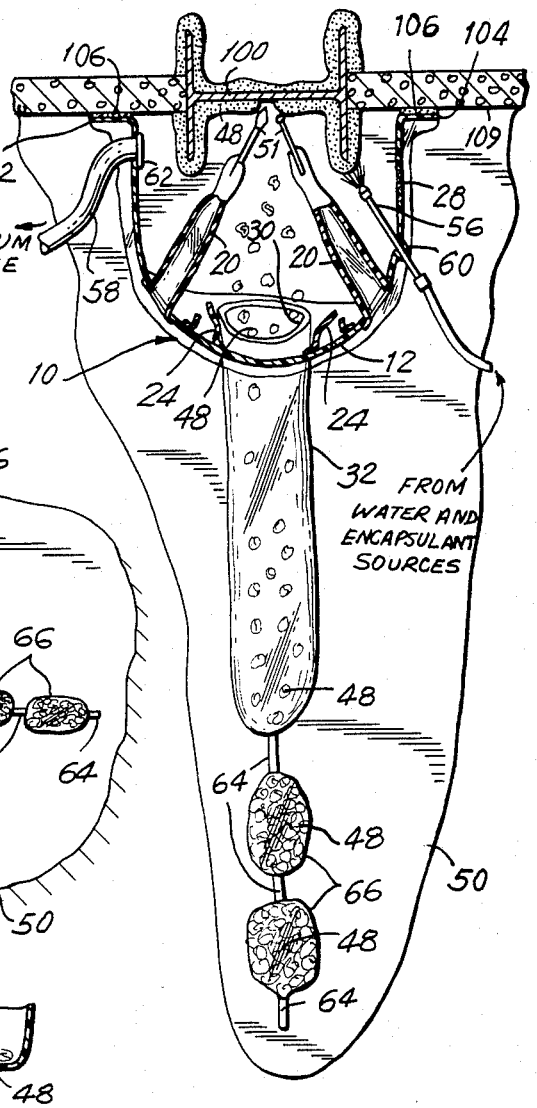
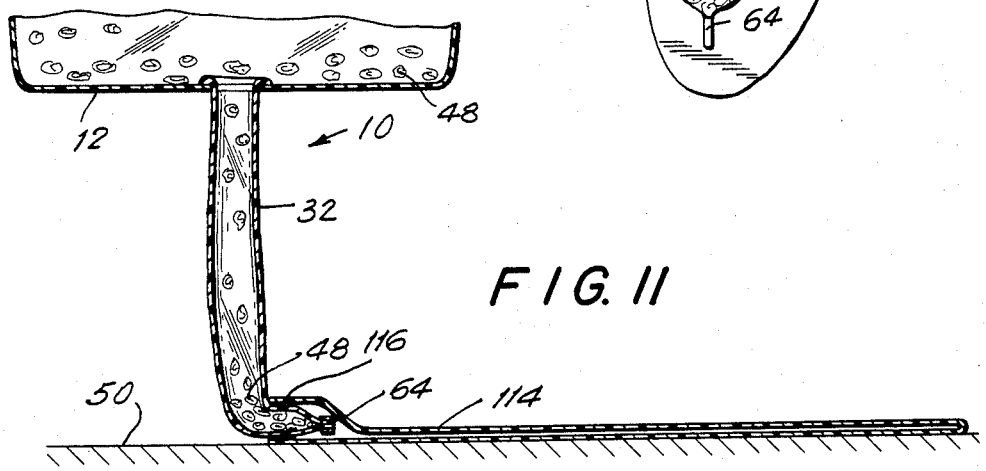
FIG. 11

APPARATUS AND METHOD FOR THE SAFE AND EFFECTIVE, LARGE SCALE REMOVAL AND DISPOSAL OF HAZARDOUS MATERIALS FROM BUILDING COMPONENTS

BACKGROUND OF THE INVENTION

1. Field of the Invention

This invention relates to new and improved apparatus and method for the safe and effective, large scale removal and disposal of extremely hazardous materials in the nature of friable asbestos-containing materials from building components.

2. Description of the Prior Art

In accordance with the current apparatus and methods of the prior art, the safe and effective, large scale removal and disposal of extremely hazardous materials in the nature of carcinogenic, friable asbestos-containing materials, for example insulation, fire-proofing and/or sound-proofing materials, from building components of relatively extensive exposed areas, for example support beams, support columns, walls, ceilings, deckings, heating and/or air conditioning systems ducts and housings, and/or large diameter pipes and pipe and valve fittings and the like, in accordance as required with extremely stringent Federal EPA and OSHA), State, and local (in, for example, New York City Local Law 76 as administered by the New York City Department of Environmental Protection) standards, generally require the particularly expensive and time-consuming erection and use at the asbestos removal site within the building in question of a complete multi-layer isolation and decontamination assembly including a plurality of separate functional chambers, interconnecting air locks, asbestos removal equipment storage areas, pluralities of "clean" rooms with triple flap curtains on each, isolated personnel decontamination showers, and a constantly operable high capacity HEPA (high efficiency particulate air) isolation and decontamination assembly filter system with high capacity (for example, 2000 CFM) air filtration system. In addition, all personnel entering into the isolation and decontamination assembly for performance of the actual asbestos removal task are, of course, required to be fully and carefully suited up in somewhat expensive single use disposable garments to prevent skin contact with the notoriously insidious asbestos fibres, and to wear respirators to prevent inhalation and/or ingestion of the same; While constant and precise monitoring of both the interior of the isolation and decontamination assembly to insure that the asbestos fibre concentration level therein does not, in any event, exceed a predetermined level, and of the building area surrounding that assembly to insure against the escape of any asbestos fibres of significance therefrom, must be accomplished. Further, the disposal of the thusly removed asbestos containing materials requires that the same be packaged within the isolation and decontamination assembly in hermetically sealed containers, and that such containers be carefully and completely decontaminated prior to the removal thereof from that assembly; and the same is required for the disposable garments of the asbestos removal personnel. Of course, the erection and use as described of this isolation and decontamination assembly at the asbestos removal site requires the prior, and in many instances particularly disruptive, time-consuming and expensive disconnection and removal of essential functional devices, for example computers, from the site to prevent the contamination thereof by the friable asbestos-containing materials, and the re-installation and reconnection thereof at the completion of the asbestos removal operation; and, in any event effectively seals off the relevant building area from any other use attendant the asbestos removal operation.

Small scale asbestos removal apparatus of limited application, generally termed "glove bags," are known in the prior art as exemplified by the "PROFO-BAG" (registered Trademark) by Asbestos Control Technology, Inc., Maple Shade, N.J.; the "COLLECTOR" by Interstate Asbestos Abatement Safety Supplies, New Haven, Conn.; the "SAFE-T-STRIP" by Asbequard Equipment, Inc., Ontario, Canada; and the "DISPOSALENE" by Omni Sales and Manufacturing, Atlanta, Ga. In each instance, these "glove bags," although believed generally satisfactory for the removal of friable asbestos-containing materials in accordance With applicable Federal, State and local standards, are strictly limited by their essential bag-like configurations and clearly specified manners of use to applications involving the removal of asbestos-containing insulation materials from pipes and pipe joint and valve fittings of decidedly limited diameters and extents, generally no more than 12" in diameter and 5' in length; and no such "glove bag" is known to applicants which can be utilized as a practical matter by more than one worker at a time for the asbestos removal task. As an overall result of the above, it will be clear to those skilled in this art that these "glove bags" are of very limited efficiency in terms of the quantities of friable asbestos-containing materials which can be safely and effectively removed per "glove bag" installation and use; and are not, in any event, in any way realistically applicable to or satisfactory for the safe and effective, large scale removal of such materials from the relatively extensive exposed areas of building components in the nature of support beams, support columns, walls, ceilings, deckings, heating and/or air conditioning systems ducts and housings, and/or large diameter pipes and like pipe and valve fittings of not insubstantial length.

In addition, in certain instances, for example those involving the use of the "PROFO-BAG," it is necessary that the sides of the "bag" be cut in somewhat precise manner on site to fit the size of the pipe from which the friable asbestos-containing insulation is to be removed; and it will be clear that a significant measure of care must be exercised attendant this "bag" cutting to preserve the absolutely essential structural integrity of the remainder of the "bag." Too, other of these "glove bags," for example the "SAFE-T-STRIP," require the use of relatively extensive zipper mechanisms for the opening of the "bag" and the suitable attachment thereof to the pipe insulation to be removed; and it will be clear that these zipper mechanisms add very substantially to the overall cost of the "bag," and introduce an undeniable element of possible unreliability to the use thereof for the simple reason that no one has as yet invented an absolutely reliable zipper. Also, and of particular consequence, is the fact that disposal of the asbestos removed through "glove bag" utilization as described is of necessity on a "one shot" basis commensurate with the capacity of the "bag," e.g. once the "bag" is "full" the same must be sealed and removed from the supporting pipe for ultimate disposal; and this fact of course functions to absolutely limit the usable capacity of the "bag," and thus the amount of friable asbestos-containing materials which can be removed attendant the single permitted utilization of the non-reusable "bag", in accordance with the mass of the removed materials, the included asbestos removal tools, and the water which is invariably sprayed into the bag, which can as a practical matter be supported in the "bag" without breaking the essential air-tight seal of the "bag" around the pipe insulation and which can, again as a practical matter, be effectively contended with by the asbestos removal worker without adverse impact on the asbestos removal operation. In addition, since utilization of these "glove bags" by definition requires that some portion of the same be completely wrapped around the pipe or like structure from which the friable asbestos-containing materials are to be removed—in most instances this is the sole means for support of the "bag"—it will be immediately clear to those skilled in this art that the "glove bags" are, in any event, totally inapplicable to the removal of friable asbestos-containing materials from structures in the nature of building walls, building ceilings, building deckings, and/or semi-enclosed building support beams or support columns or the like, about which no portion of any asbestos removal apparatus can possibly be completely wrapped.

As a result of all of the above, it may be generally estimated that these "glove bags" as such are probably not realistically applicable to 95% of the very large number of asbestos removal tasks currently requiring prompt attention here in the United States alone.

SUMMARY OF THE INVENTION

As disclosed herein, the apparatus and method of our invention are directed to the safe and effective, large scale removal and disposal of extremely hazardous materials, for example carcinogenic friable asbestos-containing insulation, fire-proofing and/or sound-proofing materials, from building components such as ducts, pipes, support beams or columns, deckings, walls and ceilings and the like; and include body member means taking the form of an open sheet of a non-rigid, transparent material in the nature of polyethylene which is impervious to the hazardous materials. Hazardous material removal means taking the form of spaced pairs of operating gloves are operatively connected to the body member means to extend from one side thereof; and are readily accessible through the body member means from the opposite side thereof. Pouches for the containment of the hazardous material removal tools are carried from the same side of the body member to which the operating gloves extend; and a HEPA filter may be operatively carried from the body member means. Enclosed, hazardous material containment and disposal chute means of generally elongate configuration are provided; and comprise one closed end, and an opening formed at the opposite end thereof. The chute means are preferably of the same material as the body member means. A hazardous material removal opening is formed in the body member means; and the chute means are connected to the body member means in manner impervious to the hazardous materials, with said openings in communication. In use, the member means are sealed around the building component, for example by use of duct tape, a suitable adhesive and/or staples, to enclose the same in manner impervious to the hazardous materials, with the chute means extending to the outside of the enclosure. The hazardous materials are then removed from the building component from without the enclosure through use of the operating gloves and removal tools, with the thusly removed hazardous materials being contained within the enclosure. The thusly contained hazardous materials are moved within the enclosure and therefrom into and through the connected chute means for periodic packaging and disposal thereof by the sealing and cutting of successive portions of the chute means; thereby preventing the accumulation of the removed hazardous materials in the enclosure, and any interference thereby with the actual hazardous material removal process. In addition, exposure of the hazardous material removal workers to the removed hazardous materials is prevented as required. Since the body member means are essentially restricted in use to the building component in question, the adverse effect of the hazardous material removal process upon the building area in which that component is located is minimized; both in terms of access to that area during the removal process, and in terms of rendering unnecessary the removal and subsequent replacement of essential functional devices, for example computers or machines from that area for the duration of that process. Additional chute means may be operatively connected to the body member means as described at spaced locations on the latter, and/or operatively connected to the first-mentioned chute means outside of the enclosure to, in either or both events, significantly increase the overall hazardous material containment and disposal capacity of the chute means as a whole.

OBJECTS OF THE INVENTION

It is, accordingly, an object of our invention to provide new and improved apparatus and method for the safe and effective large scale removal and disposal of extremely hazardous materials in the nature of friable asbestos-containing materials from building components.

It is another object of our invention to provide apparatus as above which are of particularly simple and economical construction, and which require only the use of readily available and relatively inexpensive materials of proven dependability for the task at hand in the fabrication thereof.

It is another object of our invention to provide apparatus and method as above which are of particularly straightforward and readily learnable manner of application and use.

It is another object of our invention to provide apparatus and method as above which are applicable without sacrifice in safety or effectiveness to the removal and disposal of extremely hazardous materials of the nature under discussion from large surface areas of a very wide variety of building components of markedly different structural configurations.

It is another object of our invention to provide apparatus and method as above which are concomitantly operationally utilizable by a plurality of workers for the actual hazardous material removal and disposal tasks, thereby greatly increasing the rate at which hazardous material removal and disposal can be accomplished.

It is another object of our invention to provide apparatus and method as above which enable and render particularly convenient the safe and effective periodic disposal of portions of the removed hazardous materials, without interruption in the hazardous materials removal operation, thereby preventing those materials from accumulating in such mass as could impede the removal process.

It is another object of our invention to provide apparatus as above which are readily disposable, in economically realistic manner, after but a single utilization.

It is another object of our invention to provide apparatus and method as above which completely do away with the requirement attendant large scale hazardous removal operations for the fabrication, use and subsequent dismantling at the actual hazardous removal site of a complex and expensive isolation and decontamination assembly, and with the attendant requirement that the hazardous material removal workers be completely suited-up in protective clothing and respirator-equipped to prevent exposure to the hazardous materials.

It is another object of our invention to provide apparatus and method as above which, in use, are essentially restricted to the relevant surfaces of the building components from which the hazardous materials are to be removed, thereby minimizing the adverse effect of the apparatus upon free access to the building areas in which these components are located, and upon the performance of essential tasks in those areas concomitantly with the hazardous material removal operation.

It is another object of our invention to provide apparatus and method as above which do not require the removal of functional devices in the nature of computers or machinery or the like from the building areas in which the hazardous material removal and disposal operation is being performed.

It is another object of our invention to provide apparatus and method as above which very significantly decrease the overall expenditures in time and money required for the hazardous material removal and disposal operation.

DESCRIPTION OF THE DRAWINGS

The above and other objects and significant advantages of our invention are believed made clear by the following detailed description thereof taken in conjunction with the accompanying drawings wherein:

FIG. 7 is a perspective view, with parts broken away, illustrating a third representative application of the apparatus and method of our invention to the removal of hazardous materials from building components;

FIG. 8 is a horizontal cross-sectional view taken essentially along 8—8 in FIG. 7;

FIG. 11 is a perspective view of the illustrative parts of a fourth embodiment of apparatus representatively configured and operable in accordance with the teachings of our invention.

DETAILED DESCRIPTION OF THE INVENTION

Figure 1:
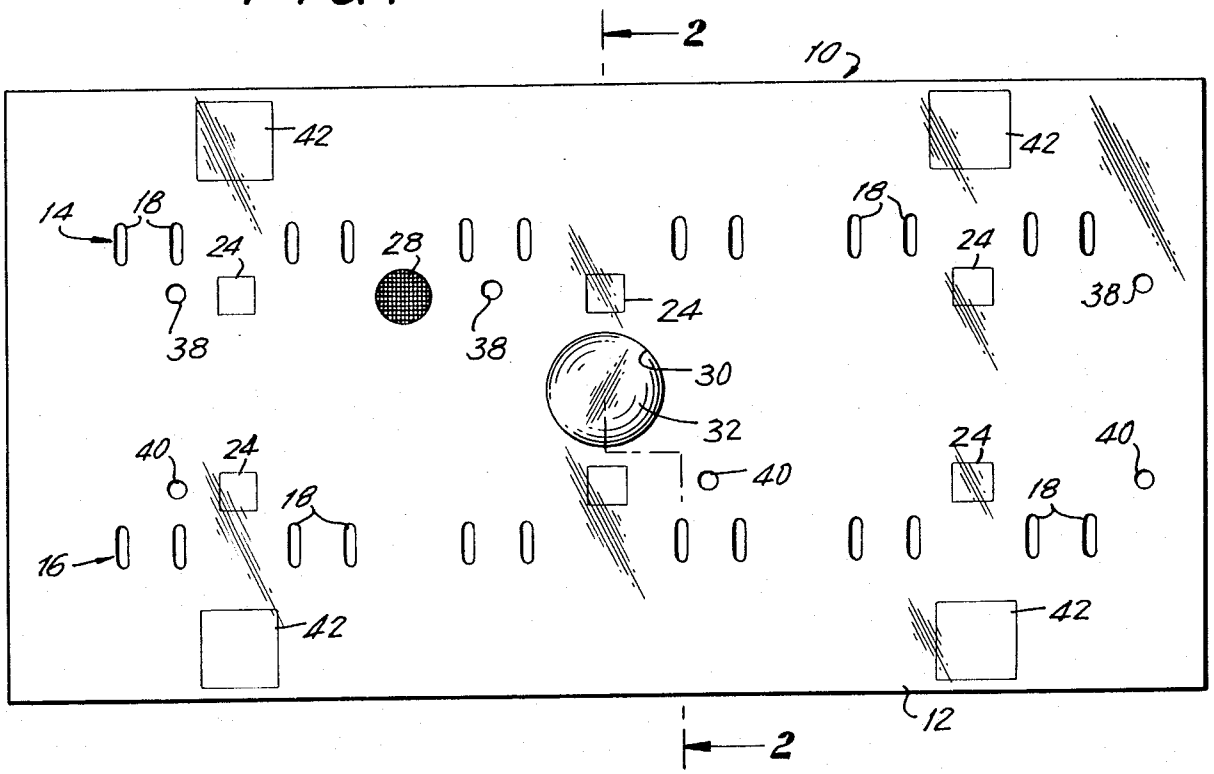
FIG. 1 is a bottom plan view of apparatus representatively configured and operable in accordance with the teachings of our invention.
Figure 2:
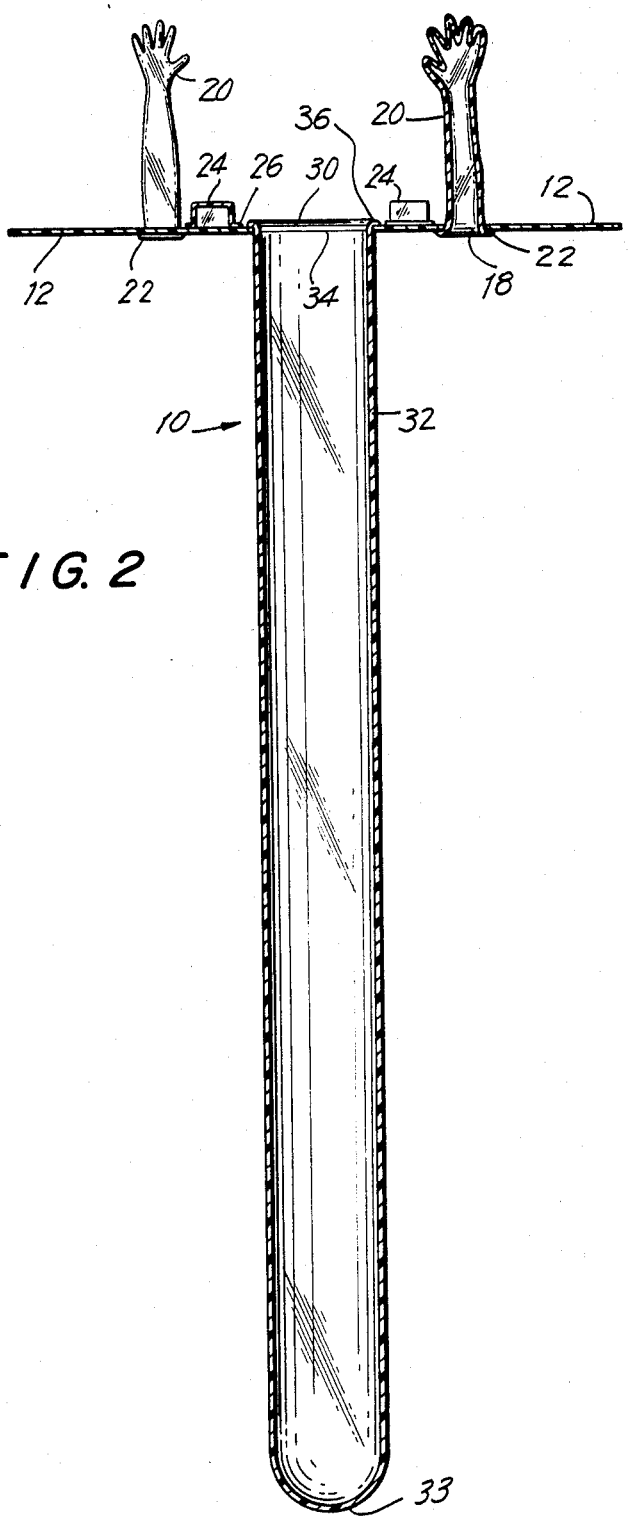
FIG. 2 is a vertical cross-section view taken essentially along line 2—2 of FIG. 1 and turned through 180° for purposes of clarity illustration.

Referring now to FIGS. 1 and 2 of the patent application drawings, new and improved apparatus for the safe and effective, large scale removal and disposal of extremely hazardous materials from building components representatively configured and operable in accordance with the teachings of our invention are indicated generally at 10; and comprise enclosure means taking the form of a generally rectangular body member 12 which is made from an open sheet of any readily available, non-rigid, transparent air-tight material of suitable strength and stability at temperatures ranging from 45 to 150 degrees F. For use of the apparatus 10 in the removal and disposal of carcinogenic, friable asbestos-containing materials as described in some detail hereinbelow, relatively inexpensive clear polyethylene sheeting of for example, 8 mil thickness, which is of course impervious to friable asbestos materials, and which may be very readily cut or initially fabricated to the desired size, has proven particularly satisfactory for the formation of the body member 12.

Spaced rows as indicated at 14 and 16 in FIG. 1 of spaced, aligned pairs of access apertures 18 are formed as shown to extend through the body member 12. Hazardous material removal means taking the form of air-tight operating gloves are indicated at 20 in FIG. 2; and it will be readily understood by those skilled in this art that one such operating glove 20 is provided per access aperture 18. In each instance, the operating glove 20 is attached in air-tight manner, for example by a suitable adhesive or appropriate thermoplastic bonding technique as indicated at 22 in FIG. 2, to the body member 12 in alignment with and completely surrounding the access aperture 18 of interest. polyethylene sheet material as described hereinabove is a satisfactory material for the respective arm and hand portions of the operating gloves 20.

Tool pouches for the containment of the tools required for the hazardous material removal operation, and for one or more rolls of duct tape as may be required therefor, are indicated at 24; and are, of course, supported from the body member 12. The tool pouches 24 may be made of the same polyethylene sheet material as the body member 12; and are each securely affixed thereto, for example by a suitable adhesive or appropriate thermoplastic bonding technique, as indicated at 26 in FIG 2. FIG. 1 makes clear that one tool pouch 24 is provided intermediate every two pairs of access apertures 18 and operating gloves 20; and the location of the tool pouch relative to the access aperture and operating glove pair in each instance is, of course, predetermined to maximize convenience of apparatus operation as made clearer hereinbelow.

An optional HEPA filter is indicated at 28 in FIG. 1; and is operatively disposed as shown at a representative location in a suitable mounting aperture in body member 12. For use of the apparatus 10 with the HEPA filter 28 included therein for the removal and disposal of friable asbestos-containing materials in accordance with applicable Federal, State and local regulatory standards, the filter should have a filter efficiency of 99.95 at particulate sizes of 0.3 microns or better.

A material removal opening of the depicted generally circular configuration is indicated at 30, and is formed a shown in the body member 12 generally centrally thereof. An enclosed, elongated material containment and disposal chute of the depicted, generally cylindrical tubular configuration is indicated at 32 and comprises a closed end as indicated at 33, and an open end as indicated at 34. The diameter of the open chute end 34 is substantially the same as the diameter of the opening 30. Preferably, the chute 32 is made of the same polyethylene material as the body member 12; and FIG. 2 makes clear that the open end 34 of the chute 32 is securely affixed in air-tight manner, for example by a suitable adhesive or thermoplastic bonding technique as indicated at 36, to the body member 12 to surround the opening 30 and be in communication therewith. This makes clear that the combination of the body member 12, operating gloves 20, and chute 32 will, as a whole, be impervious to the hazardous materials in question. It also makes clear that the chute 32 is supported from the body member 12.

Indicia for suggested locations at which the body member 12 may be conveniently cut for water and vacuum connections for reasons described in detail hereinbelow are indicated at 38 and 40; and may, for example, take the form of simple paste-on lables, or printing directly on the surface of the body member 12.

Warning labels specifying the extrememly hazardous nature of the material(s) to be removed and disposed of, and the extreme caution which must be exercised attendant the same, are representatively depicted at 42; and are preferably printed directly on the surface of the body member 12 to insure the permanance thereof attendant use of the apparatus 10.

Figures 3, 4:
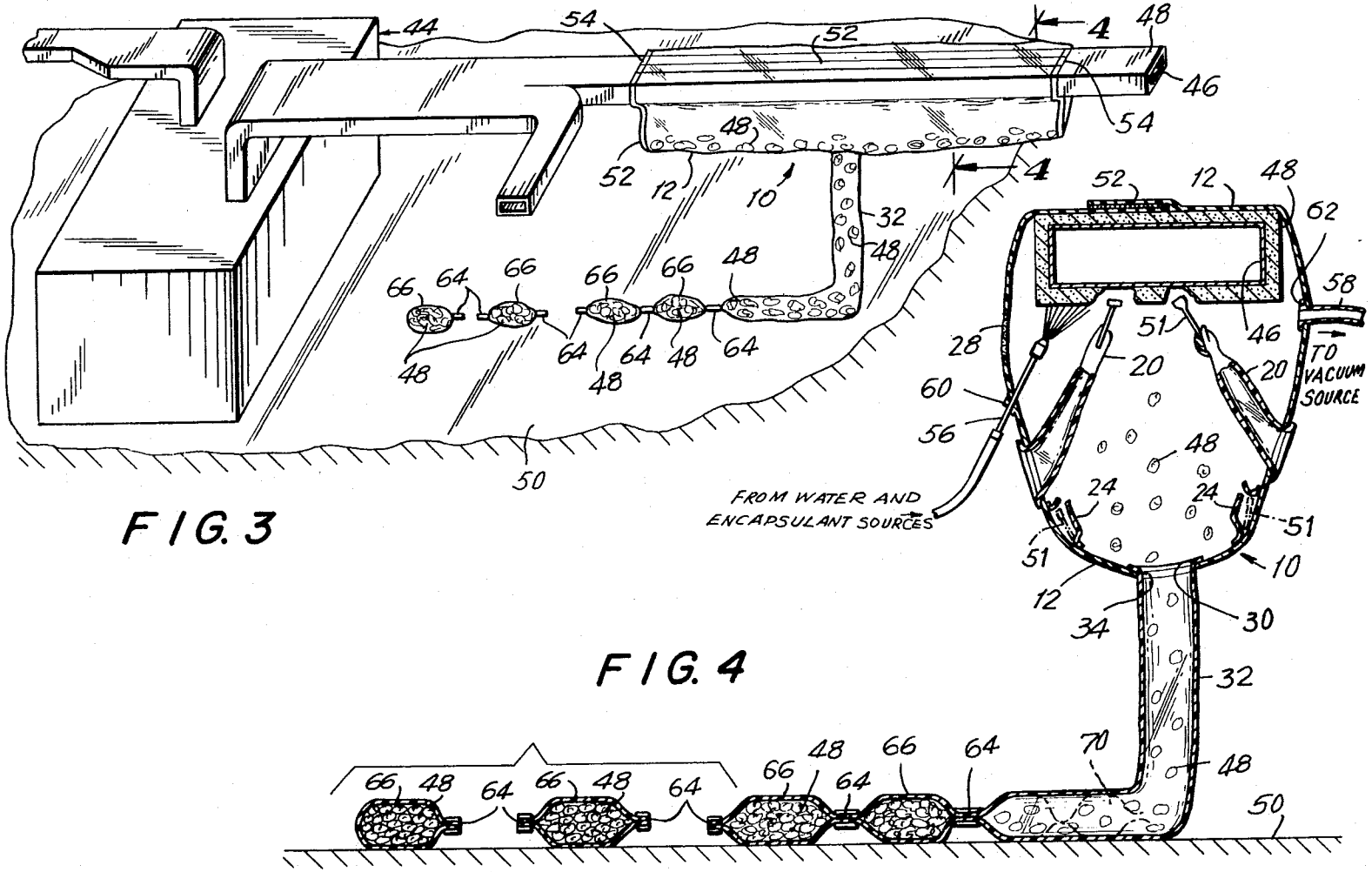
FIG. 3 is a perspective view, with parts broken away, illustrating a first representative application of the apparatus and method of our invention to the removal of hazardous material from building components.
FIG. 4 is a vertical cross-sectional view taken essentially along line 4—4 in FIG. 3.

A representative on-site application of the new and improved apparatus 10 of our invention, with filter 28 included, to the safe and effective, large scale removal of friable asbestos-containing insulation materials from a significant length of a horizontal duct of large overall surface area of a building air handling system, for example heating and/or air conditioning, is illustrated by FIGS. 3 and 4 wherein 44 indicates the air handling system generally, 46 indicates the duct of interest which is longer than the body member 12, and 48 indicates the insulation material which is to be removed therefrom.

For such application, and with the apparatus 10 representatively configured as depicted in FIGS. 1 and 2 to include twelve spaced pairs of spaced operating gloves 20 and six appropriately located tool pouches 24 for operational use in conjunction therewith, body member 12 may, for example, be 30′ in length and 16′ in width, thus resulting in an overall body member area of 480 square feet; While the material containment and disposal chute 32 may, for example, also be of 30′ in length and have a diameter of 3′ at the open chute end 34, thus resulting in a cross-sectional area of the chute 32 at the material removal opening 30 of approximately 28 square feet.

At the commencement of the friable asbestos-containing insulation material removal operation, the apparatus 10 ar simply laid out on the building floor beneath the portion of the duct 46 from which the insulation is to be removed, with the operating gloves 20 being to the side of the body member 12 facing the duct 46, and the chute 32 being to the opposite side of the body member and in contact with the building floor 50. In this representative example, the portion of the duct 46 from which the insulation material is to be removed may, for example, be 29′ in length, and 5′ in width and 2′ in depth including, of course, the insulation material 48.

Suitable insulation removal tools as indicated at 5 in FIG. 4, for example knives, scrapers, chisels and hammers and the like, and one or more rolls of duct tape, are then inserted into the tool pouches 24 for obvious purpose; and the apparatus body member 12 then simply lifted and manipulated for attachment to the duct portion of interest to totally envelope the same in absolutely air-tight manner. This is accomplished by the substantial overlapping where possible of the edges of the body member 12 and the air-tight sealing thereof to each other, and/or to the duct insulation material 48 at the respective ends of the body member 12, as the case may be, through use of staples, a suitable adhesive, and/or duct tape, all in manners well understood by those skilled in this art. Representative body member body member, and body member-duct insulation, air-tight seals, accomplished as above, are respectively indicated at 52 and 54 in FIGS. 3 and 4. FIG. 4 makes clear that, in this application, the relevant overlapping edges of the body member 12 are sealed only to each other at 52, and not to the top surface of the duct insulation 48, except of course at the body member end seals 54 of FIG. 3, thus leaving the insulation 48 at the top surface of the duct 46 freely accessible for removal therefrom upon appropriate manipulation of the operating gloves 20.

With the removal and disposal apparatus 10 thusly attached to and sealed as described in air-tight manner around the relevant duct portion 46, suitable openings are cut in the body member 12 at the indicia 38 and 40, or at other locations thereon as may be more appropriate for the task at hand, for the operative insertion thereinto of one or more water spray nozzles, and the operative connection thereto of one or more vacuum hoses, as respectively indicated at 56 and 58 in FIG. 4. Of course, the junctures of these components with the body member 12 are appropriately sealed with duct tape as indicated at 60 and 62 in FIG. 4 so as to also be air-tight.

Actual removal of the friable asbestos-containing insulation material 48 from the thusly enclosed portion of the duct 46 is then accomplished as made clear by FIG. 4 by the insertion of the hands and arms of, for example, six asbestos removal workers, into six of the twelve pairs of operating gloves, and the manipulation thereby of the water spray nozzle 56 to thoroughly wet down all exposed surfaces of the duct insulation material 48. Concomitantly, the non-illustrated vacuum source, which need only be of very low capacity, is actuated to commence the constant withdrawal of the air from within the enclosure through hose 58 for HEPA filtering and return to atmosphere. Of course, the body member-carried HEPA filter 28 enables the constant replenishment of this air from the ambient surroundings to prevent the collapse of the enclosure; and insures that in the most unlikely event of the development of pressure in the enclosure in excess of ambient, any air which escapes therethrough will have all asbestos fibres of significance removed therefrom.

With the water spray and vacuum remaining operable as described, the friable asbestos-containing insulation material 48 is progressively removed from the duct 46 by the workers through use of the operating gloves 20 and the removal 1 tools 51 in obvious manner. Periodically, these workers will utilize different pairs of the operating gloves 20 for the task at hand. As the insulation material is removed, it will fall to the bottom of the enclosure formed by the body member 12 for containment therein, whereupon the same is manipulated, with the significant assistance of the force of gravity, to enter into and fall through the material opening 30 into the material containment and disposal chute 32, generally to the beginning of the chute portion which lies flat in contact with the building floor 50. Additional workers, e.g. those not engaged in the actual insulation removal process through use of the operating gloves 20, then manipulate the chute 32 to work the thusly accumulated removed insulation material to the far end of the same.

Upon the accumulation in turn at the far end of chute 32 of removed insulation material quantities judged sufficient to warrant independent disposal, the far chute end is readily and repeatedly twisted about its own axis to effectively seal-off that quantity in air-tight manner, the thusly twisted chute portion very thoroughly and tightly taped by duct tape as indicated at 64 to insure that the same is and remains very securely sealed-off and air-tight from the remainder of the chute, and the thusly twisted and taped chute portion 64 then cleanly cut through intermediate the same to physically separate it from the remainder of the apparatus 10. As a result, a totally sealed, completely uncontaminated air-tight package as indicated at 66 in FIGS. 3 and 4 of the removed friable asbestos-containing insulation material 48 is readily and conveniently provided in each for like material disposal in full accordance with all applicable Federal, State and local standards relating thereto.

Operation continues as described, with additional totally sealed packages 66 of the removed insulation material 48 being periodically formed in turn from the removed material-filled portions of the chute 32 as illustrated in FIGS. 3 and 4 for removal from the apparatus 10 and disposal; it being clear to those skilled in this art that the capacity of the usable portion of the removed material containment and disposal chute 32, e.g. essentially that portion thereof which rests upon and is supported by building floor 50, as determined of course by its length and diameter, will be carefully predetermined in each instance in accordance with the skill, judgement and experience of the supervisor of the insulation removal operation to be more than sufficient to readily contain all the insulation material 48 as can reasonably be expected to be removed from the enclosed portion of the duct 46 of interest.

These capabilities of the apparatus and method of our invention which enable the ready and convenient movement of the removed insulation materials 48 from the enclosure formed by body member 12 into and through the chute 30 to the end portion of the latter as described concomitantly with the actual performance of the material removal task, and which enable the ready and convenient independent formation and severance as described of the chute packages 66, again concomitantly with the actual performance of the material removal task, are of particularly significant advantage in that the same:

(a) prevent the removed insulation material from accumulating in the body member-formed enclosure in such mass as could dislodge the body member 12 from the portion of the duct 46 of interest, or in any way fracture the essential air-tight seal therebetween;

(b) prevent removed insulation material accumulation in the body member-formed enclosure in such mass or volume as could encumber the continued performance of the material removal task, for example by impeding the manipulation of the body member 12 and/or the operating gloves 20; and (c) prevent the accumulation of the removed insulation material 48 in the chute 30 in such mass or volume as could encumber the continued performance of the material removal task, for example by impeding access to the body member 12 and the operating gloves 20.

Once all of the insulating material 48 as is practical to remove from the enclosed portion of the duct 46 through use of tools 51 has been removed as described, the exposed edges of the insulation material remaining within the enclosure immediately adjacent the areas Where the body member 12 is sealed thereto at 54 (FIG. 3) are thoroughly taped with duct tape within the enclosure to seal the same for obvious purposes. The entire now substantially exposed surface area of that duct portion, and all interior surfaces of the enclosure formed by the body member 12, are then very carefully and extensively sprayed with water from spray nozzle 56 for final removal in the most thorough manner possible of all remaining friable asbestos-containing insulation materials therefrom, and flow thereof along with this final and particularly effective quantity of water under the influence of gravity into the containment and disposal chute 32 for air-tight packaging as described in the final chute package as indicated at 70 in FIG. 4. This package is then taped, cut and removed for disposal as described.

The vacuum source is then deactivated, and a source of a suitable wetting agent encapsulant connected to the water source for appropriate dilution and spray as such through spray nozzle 56; again over all exposed surfaces of the enclosed portion of the duct 46, and all interior surfaces of the envelope formed by the body member 12. This functions to very tightly seal any and all very small quantities of friable asbestos-containing insulation materials 48 as may remain on the surface of the duct portion of interest to that surface in approved manner; and also functions to do likewise with regard to any such materials as may remain on the interior surfaces of the body member envelope, or in the air space enclosed thereby, thereby preventing the escape thereof into the ambient surroundings upon the removal of the apparatus 10 from the duct 46 as described directly hereinbelow.

The tools and duct tape 51 are then safely removed from the enclosure formed by the body member 12 by the simple expedient of the grasping thereof in the operating gloves 20, the withdrawal of those gloves with the tools grasped therein from the body member envelope to turn the same inside out with the tools 51 sealed therein, the twisting and taping of the arm portions of the thusly withdrawn operating gloves in the manner described for the formation of the chute packages 66, and the cutting of the thusly twisted and taped glove arm portions. This results in the thoroughly encapsulated tools 51 being removed from the apparatus 10 for placement as such in the tool pouches 24 of the next apparatus 10 to be utilized.

Monitoring of the air quality within the body member-formed enclosure to insure the compliance thereof with all applicable requirements prior to apparatus removal can then be effected if required by the careful insertion through the body member 12, in air-tight manner of an appropriate sensing device head, the taking of the necessary reading(s), the removal of the sensing device head, and the re-sealing of the body member.

For removal of the apparatus 10 from the duct 46, the vacuum source is reactivated, and spray nozzle 56 very carefully removed from the body member 12 by the careful breaking of seal 60 which is then immediately re-made. HEPA filter 28 is then sealed off as by taping to result in the collapsing of the envelope formed by body member 12 around the duct 46 as the air is withdrawn from that envelope through vacuum hose 58. The thusly collapsed body member 12 is then carefully removed from the duct 46 by the careful breaking of the seals 52 and 54 to enable the body member 12 to simply be peeled away from the duct along the longitudinal axis thereof in the direction toward the vacuum hose 58 and tightly rolled into a relatively compact package, with the vacuum still activated, for convenient insertion into an approved apparatus disposal container, all in accordance with all applicable Federal, State and local standards. The vacuum source is then deactivated, the vacuum hose 58 removed from the thusly packaged body member 12, and the disposal container closed and sealed around the latter. Thorough HEPA-filtered vacuuming of the entire work area then completes the process of the safe and effective removal of the friable asbestos-containing insulation material 48 from the portion of duct 46 under discussion, whereupon a "new" insulation removal apparatus 10 can be attached as required to an immediately adjoining portion of duct 46 for continuation of the insulation removal process as described with regard thereto.

In instances wherein the HEPA filter 28 is not included in the body member 12, operation would be the same as described except for the fact that the vacuum source would not be activated until hazardous material removal and encapsulant spray had been completed and it was desired to collapse the body member 12 as described.

Although illustrated and described as a building air handling system duct, building component 46 could alternatively be constituted by an exposed building water handling system pipe of significant diameter, for example 42", which could further include one or more valve fittings of even greater diameter along the relevant extent thereof; and it will be immediately clear that the safe and effective removal of friable asbestos-containing insulation materials from such pipe would be readily accomplishable in accordance with the teachings of our invention through use of the apparatus 10 in the same manner as described for duct 46.

Figure 5:
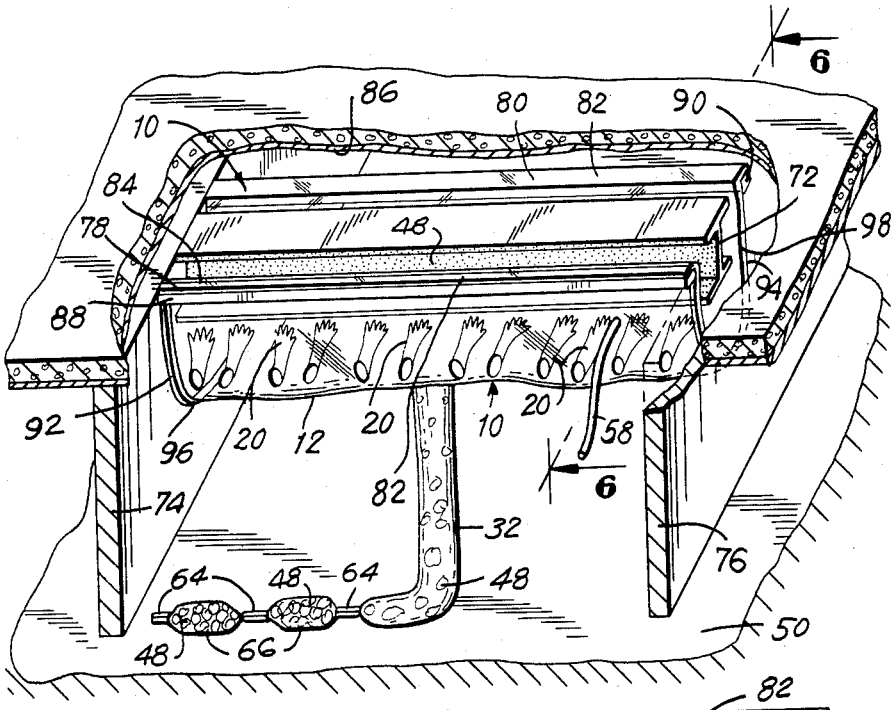
FIG. 5 is a perspective view, with parts broken away illustrating a second representative application of the apparatus and method of our invention to the removal of hazardous materials from building components.
Figure 6:
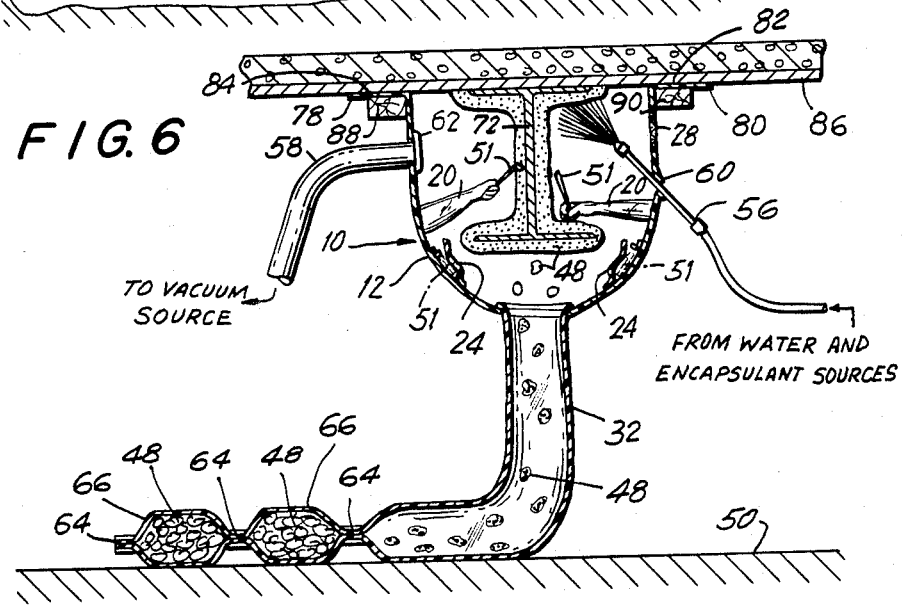
FIG. 6 is a vertical cross-sectional view taken essentially along line 6—6 in FIG. 5.

FIGS. 5 and 6 illustrate the application of the hazardous material removal apparatus 10 of our invention to the safe and effective removal and disposal of friable asbestos-containing material, as again indicated at 48, from a generally horizontally extending building support component a illustrated by I-beam 72. Assuming that in this instance beam 72 has an overall exposed span of 25' between opposed building walls 74 and 76 as seen in FIG. 5, it will be clear that apparatus body member 12 may be initially fabricated, or simply cut on site, to a length of, for example, 27' to leave a one foot overlap at each end of the beam 72 for air-tight sealing of the relevant body member edges to those building walls as described in detail hereinbelow.

For removal of the material 48 from the support beam 72, the apparatus 10 are again laid out on the building floor 50 beneath the beam with the operating gloves 20 to the upper side of the body member 12, and the material containment and disposal chute 32 disposed therebeneath. The body member 12 is then manually lifted, again through convenient use of suitable portable work platforms or the like, to surround the exposed portion of the beam 72, and the side edge portions 78 and 80 of the body member very securely attached and sealed in air-tight manner, again through use of a suitable adhesive, duct tape and/or staples as indicated at 82 and 84, to the building ceiling 86 at locations on the latter sufficiently spaced from the support beam 72 to provide more than adequate working space to either side of the latter for the removal of the insulation material 48 therefrom. Structural reinforcement for this attachment of the body member edges 78 and 80 to the ceiling member 86 may be readily provided by simple Wooden studs as indicated at 88 and 90 in FIG. 6 which are generally co-extensive with the beam 72, and which are securely attached through the body member edges 78 and 80 to the building ceiling member 86 in any suitable manner, for example non-illustrated spaced nails or the like, to very firmly press and maintain those body member edges in contact with the ceiling member. Of course, a suitable adhesive, not shown, may also be interposed between the relevant surfaces of the studs 88 and 90 and the body member edges 78 and 80 to provide even greater structural integrity to the body member-building ceiling attachment.

With the body member side edge portions 78 and 80 attached in air-tight manner as described to the building ceiling member 86, the body member end edge portions as indicated at 92 and 94 in FIG. 5 which extend into contact with and overlap the building walls 74 and 76 at opposite ends of the body member are simply folded over and securely attached in air-tight manner thereto, again through use of duct tape, a suitable adhesive, and/or staples as indicated at 96 and 98 in FIG. 5. Thus, particularly sturdy, air-tight enclosure of the support beam 72 by the body member 12 is accomplished; and the safe and effective removal and disposal of the friable asbestos-containing insulation material 48 from that support beam proceeds in essentially the same manner as heretofore described in detail with regard to the duct 46 of FIG. 3 and 4, Which need not be repeated here.

Figure 9:
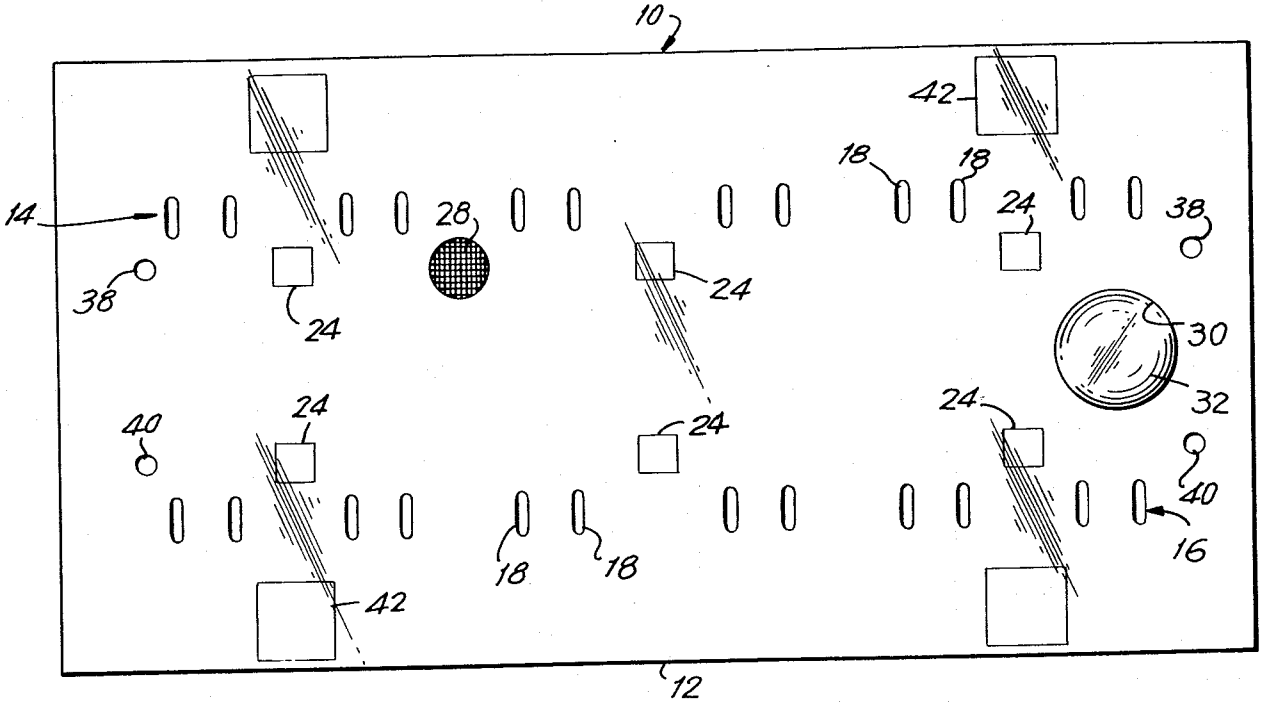
FIG. 9 is a bottom plan view of a second embodiment of apparatus configured and operable in accordance with the teachings of our invention.

FIGS. 7, 8 and 9 illustrate the application of the hazardous material removal apparatus 10 of our invention to the safe and effective removal and disposal of friable asbestos-containing insulation material, again as indicated at 48, from a generally vertically extending building support component as illustrated by I-beam 100. Assuming that in this instance support beam has an overall exposed height of 18' between building floor 50 and building ceiling 86 as seen in FIG. 7, it will be clear that apparatus body member 12 may be initially fabricated, or simply cut on site, to a length of, for example, 20' to again leave an approximately one foot overlap at each end of the support beam 100 for air-tight sealing of the relevant body member edges to that building floor and ceiling as described in detail hereinbelow.

For removal of the insulation material 48 from the support beam 100, the apparatus 12 would be configured as illustrated in FIG. 9 with the material containment and disposal chute 32 operatively connected thereto through material removal opening 30 adjacent one end of the body member 12 rather than generally centrally thereof as illustrated and described with regard to FIG. 1. In use, the thusly configured apparatus 10 are laid out on the building floor 50 adjacent support beam 100 with the operating gloves 20 facing the beam, and the chute 32 facing away from the same; whereupon the body member 12 is manually lifted, again through use of suitable work platforms or the like, to extend from the building floor 50 to the building ceiling 86 and surround the exposed portion of the support beam 100. The side edge portions 102 and 104 of the body member 12 are then very securely attached and sealed in air-tight manner, again through use of a suitable adhesive, duct tape and/or staples as indicated at 106, to the building wall 109 at locations on the latter sufficiently spaced from the support beam 100 to provide more than adequate working space to either side of the support beam within the body member 12 for the removal of the insulation material 48 from the support beam. The end edge portions as indicated at 107 and 108 of the body member 12 which extend into contact with and overlap the building floor 50 and the building ceiling 86 at opposite ends of the body member are then simply folded over and respectively securely attached thereto in air-tight manner, again through the use of duct tape, a suitable adhesive and/or staples, as indicated at 110 and 112 in FIG. 7.

With the apparatus 10 configured and attached as described to encapsulate the building support beam 100, it will be clear that the material removal opening 30 will be disposed at the lower portion of the body member 12, thereby greatly facilitating the passage of the removed insulation material 48 therethrough into the material containment and disposal chute 32 which, in this instance, will be supported throughout substantially its entire length by surface contact with the building floor 50. The safe and effective removal of the friable asbestos-containing insulation material 48 from the building support beam 100, and like disposal thereof via the chute packages 66, is accomplished in essentially the same manner as heretofore described in detail with regard to duct 46 of FIGS. 3 and 4; it being noted, however, that FIGS. 7, 8 and 9 make clear that the apparatus 10 of our invention are by no means limited to the removal of hazardous materials from generally horizontally extending building components, but rather, are equally applicable and effective to the removal of such materials from generally vertically extending building components, and to such components as may slant.

FIGS. 5, 6, 7, 8 and 9 make clear that, although not illustrated and described in detail as such, the apparatus 10 of our invention are equally applicable to the safe and effective removal and disposal of hazardous materials from not insubstantial expanses of generally horizontally extending building ceilings and/or deckings and the like, and from like expanses of generally vertically extending building walls and the like; requiring only, in each such instance, the suitably secure and air-tight attachment of the edge portions of the apparatus body member 12 to the same to form the requisite air-tight enclosures within and from which the actual hazardous material removal and disposal operations can be effectively performed as described.

Figure 10:
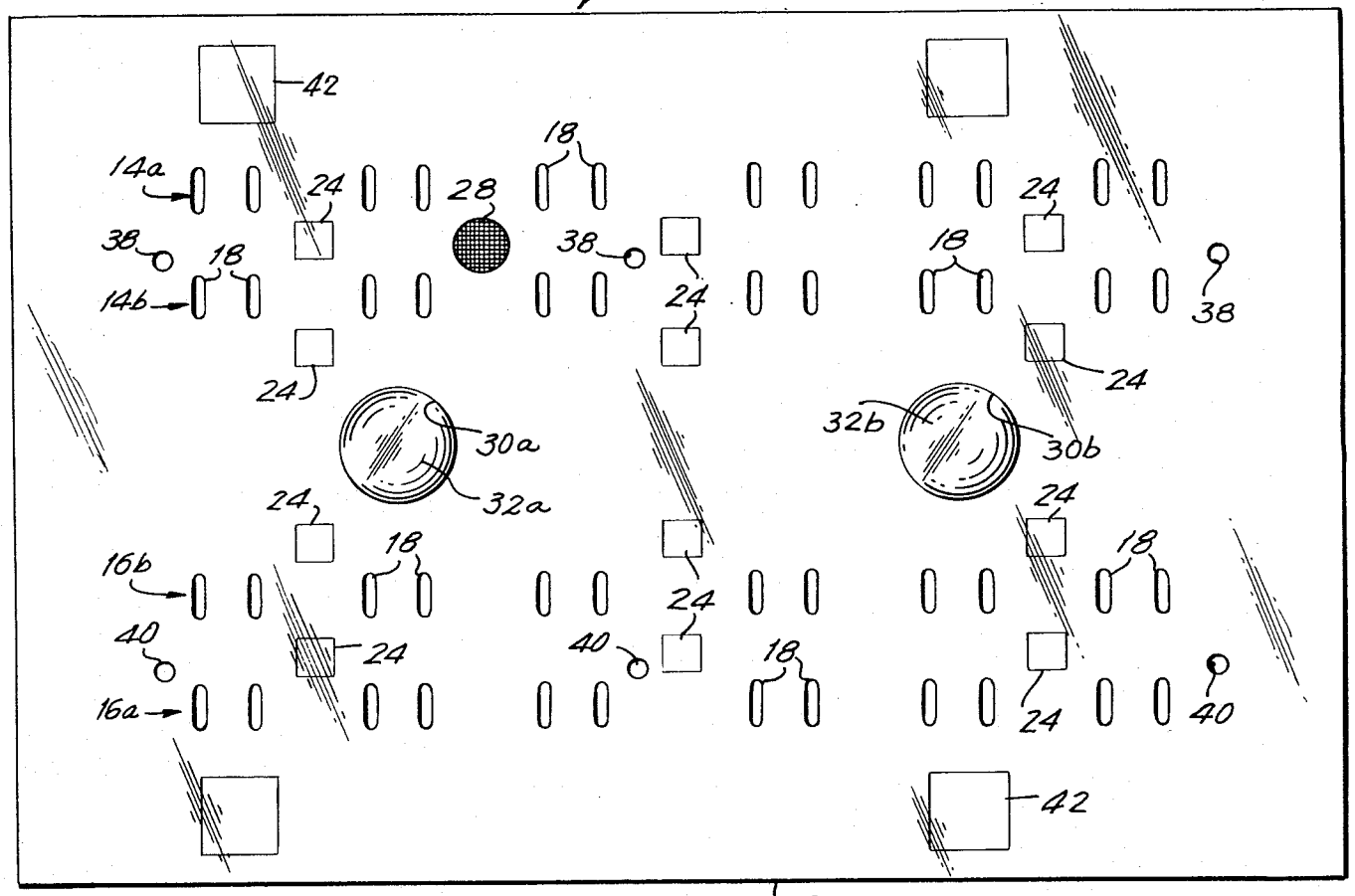
FIG. 10 is a bottom plan view of a third embodiment of apparatus representatively configured and operable in accordance with the teachings of our invention.

Although heretofore illustrated and described as comprising one material removal opening 30, one operatively connected material containment and disposal chute 32, and two spaced rows 14 and 16 of aligned spaced pairs of operating gloves 20, it is within the scope of our invention that the apparatus 10 be configured differently with regard to one or more of these features thereof. Thus, and referring now to FIG. 10, it will be clear that the apparatus 10 can be configured with two spaced material removal openings and two material containment and disposal chutes respectively operatively connected thereto, as indicated at **30*a* and 30*b*, and 32*a* and 32*b*; and could comprise four spaced rows of aligned spaced pairs of operating glove access apertures with operatively connected operating gloves, not shown, as respectively indicated at 14*a* and 14*b*, and 16*a* and 16*b*. This form of the apparatus 10 would, for example, be particularly adapted for use in hazardous material removal applications wherein very large amounts of the hazardous materials in question can reasonably be expected to be encountered for removal per unit length of the apparatus; thus warranting the two additional rows of operating gloves to provide increased access to the task at hand for the hazardous material removal workers, and requiring the additional material containment and disposal chute for the containment and disposal of the large amount of the hazardous material to be removed and safely disposed of. Alternatively, and if made of significantly larger dimensions than those heretofore discussed, for example 45′ in length by 24′ in width, the FIG. 10 form of the apparatus 10** of our invention would be particularly adapted for use in the safe and effective removal of hazardous materials from very large building component areas of the type described, for example a 40′ by 20′ expanse of building ceiling, wall or decking, as are often encountered in large industrial buildings or the like.

FIG. 11 depicts another way in which the hazardous material disposal capacity of the apparatus and method of our invention can be readily and effectively increased. More specifically, in this embodiment a second removed material containment and disposal chute as indicated at 114 is provided. In use, and upon substantial utilization as described hereinabove of chute 32 for removed material containment and disposal, the open end of chute 114 is readily and conveniently telescoped as shown for a not unsubstantial distance, for example two feet, over the closed —by taped portion 64—end of the remainder of chute 32. The thusly overlapped portions of chute 32 and 114 are then very simply albeit securely sealed together in air-tight manner through use of an adhesive and duct tape as indicated at 116 to prevent the escape of hazardous material; whereupon the sealed end portion of chute 32 is cut away from within the body member-formed enclosure, through use of a knife from one of the tool pouches 24, to connect chutes 32 and 114 for continuation of the hazardous material removal and disposal process as described.

Although in all instances depicted as resting directly for support on the building floor 50, thus avoiding unnecessary complication of illustration, it will immediately be clear to those skilled in this art that the portion(s) of the chute(s) which contain the removed hazardous materials as described may alternatively be readily and conveniently supported above that floor through use of a simple support platforms or the like, which may overlie functional devices such as computers or machinery or the like; or may alternatively be supported directly from the upper surfaces of those functional devices where appropriate. In such latter instances, those upper surfaces would preferably be covered with one or more sheets of the same material from which the body member 12 is made, simply to avoid the scratching or marring thereof attendant the hazardous material removal process. This, in any event, makes clear that particularly time-consuming, expensive and disruptive disconnection, removal, re-installation and re-connection of these functional devices is rendered unnecessary by the apparatus and method of our invention.

By all of the above is believed made clear that the new and improved hazardous material removal and disposal apparatus and method of our invention are particularly adapted in accordance with the teachings thereof to the large scale, safe and effective removal and disposal of such materials from building components to which the "glove bags" of the prior art would be totally inapplicable; and for which the only truly viable alternative in accordance with the teachings of the prior art would be the complex, expensive and time-consuming erection and use at the hazardous material removal site of the complete isolation and decontamination assembly, and the removal at the completion of the task of that assembly. As set forth hereinabove, this will in many instances require the prior, and particularly expensive, time-consuming and disruptive disconnection and removal of functional devices in the nature of computers or machines or the like from the hazardous removal site to prevent the contamination thereof by the hazardous material, and the subsequent re-installation and re-connection of those devices at the completion of the hazardous removal operation; and will, in all events, totally deny access to and passage through that site for the entire duration of the erection, use and removal of the isolation and decontamination assembly. By way of contrast, it will be immediately clear to those skilled in this art that, in accordance with the teachings of the apparatus and method of our invention, these problems are, for the most part, eliminated.

Although time comparisons with regard to the safe and effective removal of hazardous materials under actual field conditions are, of necessity, somewhat inexact due in large measure to the number of variables inherent therein, for example the skill and conscientiousness of the material removal workers, it has been determined that, in many instances, the total time required for safe and effective hazardous material removal for a particular large scale application in accordance with the teachings of our invention is not appreciably greater than the total time required for the setting up alone of a multi-layer isolation and decontamination chamber, prior to the actual removal and disposal of any hazardous material, in accordance with the principles of the prior art.

Of course, all dimensions specified hereinabove, although representative, are by way of example, only, and may be varied throughout reasonable ranges within the scope of our invention. Too, although representatively disclosed as rectangular, it is clear that body member 12 may take other and different configuration.

Various changes may, of course, be made in the herein disclosed preferred embodiments of our invention without departing from the spirit and scope thereof as defined by the appended claims.

What is claimed is:

1. An apparatus for the removal and disposal of hazardous materials from a region of a structure containing said hazardous materials, said apparatus comprising:

(a) a sheet of non-rigid material which is impervious to said hazardous material, said sheet being sized and shaped for forming an enclosure about said region, said enclosure being for containing said hazardous material and being impervious thereto; said sheet having dimensions of sufficient size so that said region enclosed by said enclosure contains quantities of hazardous material having a mass which, when removed from said region of said structure enclosed by said enclosure would interfere with further removal of hazardous material if said hazardous material remained in said enclosure;

(b) removal means for facilitating removal of said hazardous material from said structure, said removal means being operated within said enclosure from outside said enclosure;

(c) chute means having a volume at least sufficient for containing said hazardous material removed from said structure by said removal means, said chute means being formed of a nonrigid material which is impervious to said hazardous material, said chute means being permanently attached to said sheet and extending therefrom so that interior portions of said enclosure formed by said sheet are in communication with interior portions of said chute means, said chute means being sized, shaped and positioned along said sheet so that said hazardous material removed from said region by said removal means is movable directly from said enclosure into said chute means and a disposal means, said disposal means being a part of said chute means most remote from said enclosure, said disposal means of said chute means being separable from a remaining portion of said chute means so that said disposal means and said remaining portion remain sealed, and so that a sealed disposal means is disposable independently of said sheet and said remaining portion of said chute means.

2. The apparatus of claim 1 wherein said chute means has a length sufficient so that when said disposal means is separated from the remaining portion of said chute means, said remaining portion defines at least one additional disposal means, said at least one additional disposal means being a part of said remaining portion of said chute means most remote from said enclosure.

3. The apparatus of claim 1, wherein said chute means is sized, shaped and positioned and said removal means are positioned along said sheet so that said removal means is usable to facilitate moving said hazardous material from said enclosure to said chute means.

4. The apparatus of claim 1, wherein said chute means is positioned along said enclosure so that gravity assists in moving said hazardous material from said enclosure into said chute means.

5. The apparatus of claim 1, wherein said chute means has a cross sectional dimension smaller than that of said enclosure defined by said sheet.

6. The apparatus of claim 1, wherein said chute means has a length at least as great that of said sheet.

7. The apparatus of claim 1, wherein said chute means is of a length sufficient so that at least a portion of said chute means is supported by a substantially horizontal support means adjacent said structure, so that weight of said hazardous material in said chute means is supported by said horizontal support means.

8. The apparatus of claim 1, further comprising fastening means for fastening edges of said sheet adjacent to said regions of said structure containing said hazardous material so that said enclosure is formed to be impervious to said hazardous material.

9. The apparatus of claim 8, wherein said fastening means fastens a portion of said sheet to other portions of said sheet.

10. The apparatus of claim 1, further comprising sealing means, said sealing means being for sealing said chute means at a sealing region along the length of said chute means to define said disposal means on one side of said sealing region and said remaining portion of said chute means to another side of sealing region.

11. The apparatus of claim 1, wherein said chute means comprises at least one chute extending from said sheet, said at least one chute being substantially tubular.

12. The apparatus of claim 11, wherein said at least one chute is substantially cylindrical.

13. The apparatus of claim 11, wherein said at least one chute extends from said sheet substantially centrally of said sheet.

14. The apparatus of claim 1, wherein said chute means extends from said sheet adjacent an edge of said sheet.

15. The apparatus of claim 1, further comprising second chute means formed of a non-rigid material which is impervious to said hazardous material, said second chute means being connectable to said first chute means so that interior portions of said first chute means are in communication with interior portions of said second chute means, to form an extended chute means impervious to said hazardous material.

16. The apparatus of claim 1 further comprising, filter means operatively connected to said enclosure and operative to enable passage of air therethrough into and out of said enclosure, while preventing passage of hazardous materials out of said enclosure.

17. The apparatus of claim 16, further comprising vacuum means connected to said enclosure for removing air from said enclosure when said hazardous material is being removed, so that ambient air is drawn into said enclosure through said filter means and withdrawn from said enclosure by said vacuum means, thereby removing airborne hazardous material from said enclosure.

18. The apparatus of claim 1, wherein said sheet and said chute means are formed of a transparent material.

19. The apparatus of claim 1, wherein said removal means comprises glove means, said glove means extending from said sheet and connected therewith in a manner impervious to the hazardous material and defining a part of said enclosure, said glove means being shaped to receive hands of a worker exterior of said enclosure.

20. A process for the removal of hazardous material from a region of a structure comprising the steps of:

(a) enclosing said region with a non-rigid sheet of a material impervious to said hazardous material to form an enclosure impervious to said hazardous material;

(b) removing the hazardous material from said region by using a removal means within said enclosure operated from outside said enclosure;

(c) moving the hazardous material from said enclosure into an elongate chute having an interior portion in communication with an interior portion of said enclosure; said material being moved to a disposal region of said chute most remote from said enclosure;

(d) sealing said removed hazardous material in said disposal region of said chute so that said disposal region and the reminder of said chute are both sealed;

(e) separating said disposal region of said chute from said remaining portion of said chute so that said disposal region and the remainder of said chute both remain sealed; and (f) disposing of said disposal region of said chute independently of said enclosure and said remaining portion of said chute.

21. The process of claim 20, wherein said step of enclosing said region includes enclosing a region having a quantity of hazardous material sufficient to interfere with further removal of hazardous material if said hazardous material remains in said enclosure.

22. The process of claim 20, further comprising repeating steps (b) to (f) at least once.

23. The process of claim 20, further comprising the step of supporting said chute independently of said sheet so that weight of removed hazardous material in said chute is not supported by said enclosure.

24. The process of claim 20, further comprising the step of drawing ambient air through said enclosure so that airborne hazardous materials in said enclosure are removed therefrom.

25. The method of claim 20, further comprising the step of connecting a second chute to said first chute so that interior portions of said first chute are in connection with portions of said second chute impervious to said hazardous material.

* * * * *